US006511590B1

(12) United States Patent
Troup et al.

(10) Patent No.: US 6,511,590 B1
(45) Date of Patent: Jan. 28, 2003

(54) ALUMINA DISTRIBUTION IN ELECTROLYSIS CELLS INCLUDING INERT ANODES USING BUBBLE-DRIVEN BATH CIRCULATION

(75) Inventors: R. Lee Troup, Murrysville, PA (US); Gerald E. Carkin, Tarentum, PA (US); Don R. Careatti, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 3 days.

(21) Appl. No.: 09/685,483

(22) Filed: Oct. 10, 2000

(51) Int. Cl.[7] ..... C25C 3/08; C25C 3/00

(52) U.S. Cl. ..... 205/376; 205/381; 205/385; 205/386; 204/243.1; 204/244; 204/247; 204/291

(58) Field of Search ..... 204/245, 291, 204/244, 246–247; 205/381, 385, 386, 243.1, 376

(56) References Cited

U.S. PATENT DOCUMENTS

| | | | | |
|---|---|---|---|---|
| 3,400,061 A | | 9/1968 | Lewis et al. | 204/67 |
| 4,374,050 A | | 2/1983 | Ray | 252/519 |
| 4,374,761 A | | 2/1983 | Ray | 252/519 |
| 4,392,925 A | | 7/1983 | Alder et al. | 204/67 |
| 4,399,008 A | | 8/1983 | Ray | 204/67 |
| 4,455,211 A | | 6/1984 | Ray et al. | 204/293 |
| 4,582,585 A | | 4/1986 | Ray | 204/243 R |
| 4,584,172 A | | 4/1986 | Ray et al. | 419/34 |
| 4,602,990 A | | 7/1986 | Boxall et al. | 204/243 |
| 4,614,569 A | * | 9/1986 | Duruz et al. | 205/372 |
| 4,620,905 A | | 11/1986 | Tarcy et al. | 204/64 R |
| 5,158,655 A | | 10/1992 | Townsend | 204/67 |
| 5,279,715 A | | 1/1994 | LaCamera et al. | 204/64 R |
| 5,330,631 A | * | 7/1994 | Juric et al. | 204/247 X |
| 5,362,366 A | | 11/1994 | De Nora et al. | 204/67 |
| 5,368,702 A | * | 11/1994 | de Nora | 204/247 X |
| 5,492,604 A | | 2/1996 | Ray | 205/373 |
| 5,510,008 A | * | 4/1996 | Sekhar et al. | 205/384 |
| 5,683,559 A | * | 11/1997 | de Nora | 204/243 R |
| 5,794,112 A | | 8/1998 | Ray et al. | 419/21 |
| 5,865,980 A | | 2/1999 | Ray et al. | 205/367 |
| 5,888,360 A | | 3/1999 | de Nora | 204/243 |
| 5,938,914 A | | 8/1999 | Dawless et al. | 205/391 |
| 6,093,604 A | * | 7/2000 | de Nora | 205/381 |
| 6,126,799 A | | 10/2000 | Ray et al. | 204/291 |
| 6,162,334 A | | 12/2000 | Ray et al. | 204/290.14 |
| 6,217,739 B1 | | 4/2001 | Ray et al. | 205/385 |
| 6,245,201 B1 | * | 6/2001 | Rendall | 204/247 |
| 6,358,393 B1 | * | 3/2002 | Berclaz et al. | 205/374 |

FOREIGN PATENT DOCUMENTS

WO WO 98/53120 * 11/1998

* cited by examiner

*Primary Examiner*—Donald R. Valentine
(74) *Attorney, Agent, or Firm*—Tracey D. Beiriger

(57) ABSTRACT

This invention relates to the use of bubble-driven flow to enhance the dissolution and distribution of alumina in an aluminum electrolysis cell operating with inert anodes. By harnessing the driving force of bubbles rising along the sides of a sloped anode to induce circulation in a cell and by using a group of anodes to amplify the effect, alumina distribution can be maintained close to or at saturation without formation of muck/sludge. Alumina fed through point feeders at specific locations can be distributed throughout the entire cell rather than sinking to the bottom of the cell below the feed location. For a given circulation pattern, feeder locations can be optimized.

18 Claims, 3 Drawing Sheets

ALUMINA DISTRIBUTION IN ELECTROLYSIS CELLS INCLUDING INERT ANODES USING BUBBLE-DRIVEN BATH CIRCULATION

FIELD OF THE INVENTION

The present invention relates to electrolytic aluminum production cells, and more particularly relates to systems for improving alumina distribution in such cells by controlling the flow patterns of oxygen bubbles generated during the aluminum production process.

BACKGROUND INFORMATION

Electrolytic cells of the Hall-Heroult type are used to smelt alumina ore into aluminum metal. These cells use consumable carbon anodes which have several disadvantages. For instance, the $CO_2$ released by the reaction of the carbon with oxygen from the alumina ore may cause environmental problems. Also, because the anodes are consumed they must be replaced every 3–4 weeks. Replacing an anode disrupts cell operation due to the associated cooling effects, electrical imbalance and release of fluoride emissions. Environmental emissions are associated not only with the use of carbon anodes, but with the production of carbon anodes as well.

Carbon anodes can be replaced by inert anodes that release $O_2$ instead of $CO_2$, do not require changing and can be manufactured in an environmentally-friendly way. A promising inert anode material is a cermet consisting of an oxide matrix based on nickel-iron-ferrite or nickel ferrite, and other additives surrounding a highly conductive, metal phase containing Cu, Ag and other additives. Although the oxides in the cermet may be soluble to some extent in the cryolite-based electrolyte (bath) and may be reduced by aluminum metal, it is possible to reduce anode corrosion to a very low level so that the anodes are essentially inert. One approach for reducing corrosion rate is to maintain the concentration of alumina in the bath at or near saturation. It is especially important to avoid alumina depletion near the active surfaces of the anodes.

Achieving a high and uniform alumina concentration adjacent to the anodes requires optimization of two processes, alumina dissolution and alumina distribution. In the dissolution process cold alumina is fed to a cell and molten bath freezes on the alumina grains. Heat must be supplied to raise the temperature of the alumina to the cell temperature and melt the frozen bath. Then additional heat of solution must be supplied. This process is limited by heat transfer because, in order to increase current efficiency, cells are run with a small superheat. The dissolution process also involves mass transfer between the bath near the alumina grains and bulk bath. These have compositions of $C_{saturation}$ and $C_{bulk}$. The rate depends on $(C_{saturation}-C_{bulk})$. This difference approaches zero in the inert anode cell run near saturation.

If alumina does not completely dissolve, the excess tends to form muck or sludge, a mixture of bath and undissolved alumina that collects on the bottom of the cell under the metal layer or "pad". This muck causes maldistribution of current, leading to a "noisy" cell that tends to run at higher voltage and lower current efficiency than a cell without muck. The muck often forms hard deposits on the cell bottom which are difficult to remove and perpetuate the noisy condition. Modern Hall-Heroult cells are normally run "lean", i.e., the alumina concentration is relatively low and far from saturation. A lean operation reduces the amount of undissolved alumina in the cell because the driving force for dissolution is increased. Alumina concentration is typically more uniform in a "lean" cell than in a "rich" cell.

Once the alumina dissolves, the enriched bath must be distributed throughout the cell to feed the anode reaction. In modem pre-bake carbon cells, alumina is usually added to a few locations called point feeders. In conventional aluminum smelting cells with carbon anodes, alumina distribution is relatively slow. Based on water model tracer tests, it has been observed that, after feeding a shot of alumina through a point feeder, it may take 0.5–1 hour for the bath concentration to become uniform. Bubble-driven flow creates circulation locally around each anode but does not drive large-scale circulation in the cell. Overall cell circulation is driven mainly by electromagnetic forces and turbulent diffusivity. Cell designers have traditionally attempted to minimize these forces because they adversely affect power efficiency.

Since an inert anode cell is preferably run "rich" in alumina to avoid corrosion of the anodes, suitable means must be used to enhance dissolution and distribution in order to avoid muck and to insure a uniformly high concentration of alumina in the bath adjacent to the anodes. Examples of such means are the use of high-surface-area, gamma alumina that dissolves readily, preheating the alumina to reduce thermal requirements, and feeding continuously at optimized feeder locations. In spite of the application of these and other methods, muck is a problem in inert anode cells.

DETAILED DESCRIPTION

In an aluminum smelting cell operated with inert anodes, oxygen bubbles are generated predominately on the bottom and, to a lesser extent, on the submerged sides of the inert anodes. These bubbles rise to the surface as a bubble curtain. The bubbles reduce the density of the bath in the vicinity of the anode, resulting in a buoyancy force. Flow under conventional anode designs is relatively weak.

The present invention utilizes a slight slope on the bottom of each anode and the orientation of the slope directions in a group of anodes to drive cell circulation. This cell circulation can include the entire cell or a region of the cell containing several anodes, preferably four or more anodes. Alumina point feeders are positioned to feed into the circulation. Cell circulation results in flow loops inside, outside and under the group(s) of anodes.

If the anode bottom is flat, bubbles roll off the bottom and up the anode sides substantially uniformly around the anode circumference. This creates circulation in the vertical, radial planes bounded by the anode, the surface, the cell wall and the metal pad. If the anode bottom is sloped slightly in accordance with the present invention, bubble-driven flow is biased in the direction of the slope. This tends to drive local circulation in the cell in the direction of the slope, defined herein as the predominate bubble-driven flow direction (PBDFD). When several inert anodes are grouped together their slope directions can be oriented so that the cell circulation is reinforced by each anode in turn. For example, a rectangular cell may contain a rectangular array of four anodes with bottom slopes of 0.5–3 degrees measured from a horizontal plane. Proceeding around the cell in a counterclockwise direction, if the PBDFD of each anode is not perpendicular to an adjacent cell wall and rotated 90 degrees relative to the preceding anode, a counterclockwise circulation pattern will be produced in the bath.

Figure 1:
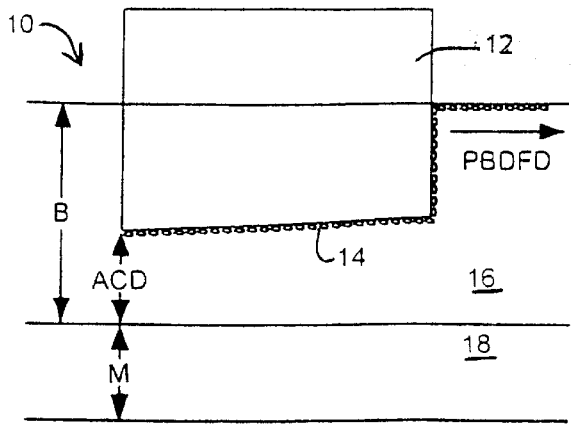
FIG. 1 is a partially schematic side view of an electrolysis cell including an inert anode having a slightly angled lower surface which produces a controlled oxygen bubble flow pattern in accordance with an embodiment of the present invention.

FIG. 1 is a partially schematic side view of a portion of an electrolysis cell 10 including an inert anode 12 having an angled lower surface 14. The inert anode 12 is partially submerged in a molten electrolytic bath 16 which comprises, for example, NaF and $AlF_3$ in a controlled ratio. During operation of the cell 10, a molten metal pad 18 is formed at the bottom of the cell. The molten metal pad 18 has a depth M, while the bath 16 has a depth B. The distance between the upper surface of the molten metal pad 18 and the lowermost surface of the inert anode 12 is known as the anode cathode distance (ACD). In a typical aluminum smelting cell, the distance M may be about 3 inches, the distance B may be about 7 inches, and the ACD may be about 3 inches. As shown in FIG. 1, a PBDFD bubble flow pattern is generated as a result of the angled lower surface 14.

Figure 2:
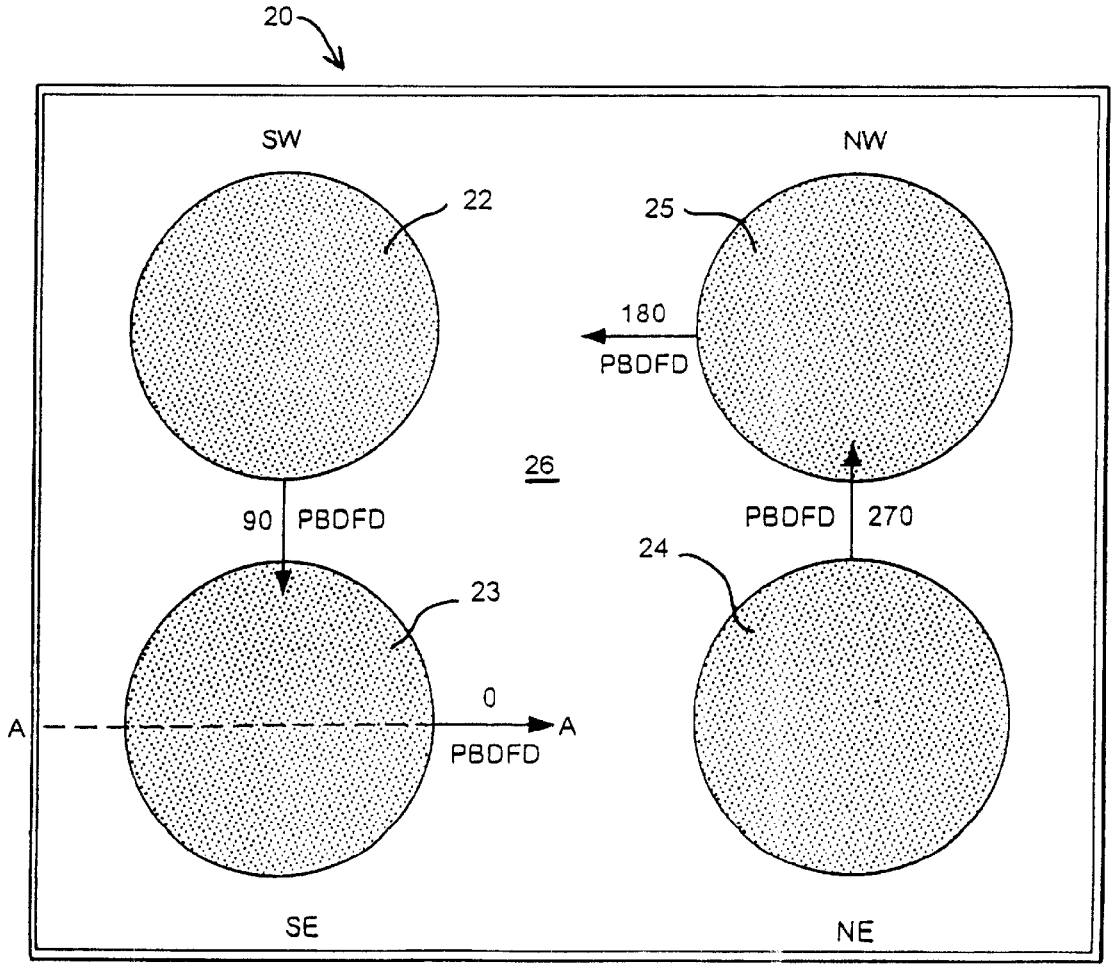
FIG. 2 is a partially schematic plan view of an electrolysis cell having four inert anodes which generate an oxygen bubble flow pattern in accordance with an embodiment of the present invention.

FIG. 2 is a partially schematic top view of an electrolysis cell 20 in accordance with an embodiment of the present invention having four inert anodes 22, 23, 24 and 25. The lower surface of each inert anode is slightly angled in accordance with the present invention to provide a PBDFD bubble flow pattern within the electrolytic bath 26 of the cell 20. As shown in FIG. 2, the angled lower surface of each inert anode is oriented at a 90° angle with respect to its adjacent inert anodes. In this manner, a counter-clockwise circulation pattern is generated in the electrolytic bath 26.

Figure 3:
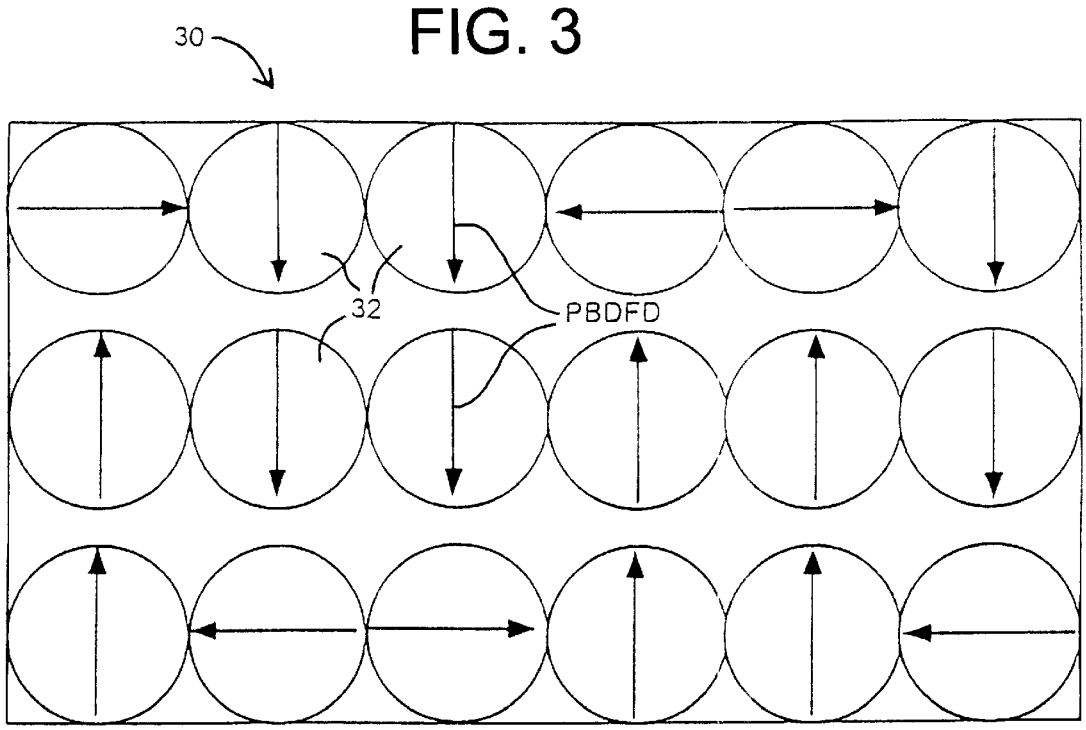
FIG. 3 is a partially schematic plan view of an electrolysis cell having eighteen inert anodes which generate an oxygen bubble flow pattern in accordance with an embodiment of the present invention.

FIG. 3 is a partially schematic top view of an electrolysis cell 30 in accordance with another embodiment of the present invention having eighteen inert anodes 32 which generate a PBDFD pattern. In this embodiment, the angled lower surfaces of the inert anodes 32 are oriented such that three separate flow patterns are generated in the cell 30. The group of six inert anodes at the left side of the cell 30 shown in FIG. 3 generate a clockwise flow pattern. Similarly, the group of six inert anodes at the right of the cell 30 generate a clockwise flow pattern. The central group of six inert anodes shown in FIG. 3 generate a counter-clockwise flow pattern in the middle of the cell 30.

Figure 4:
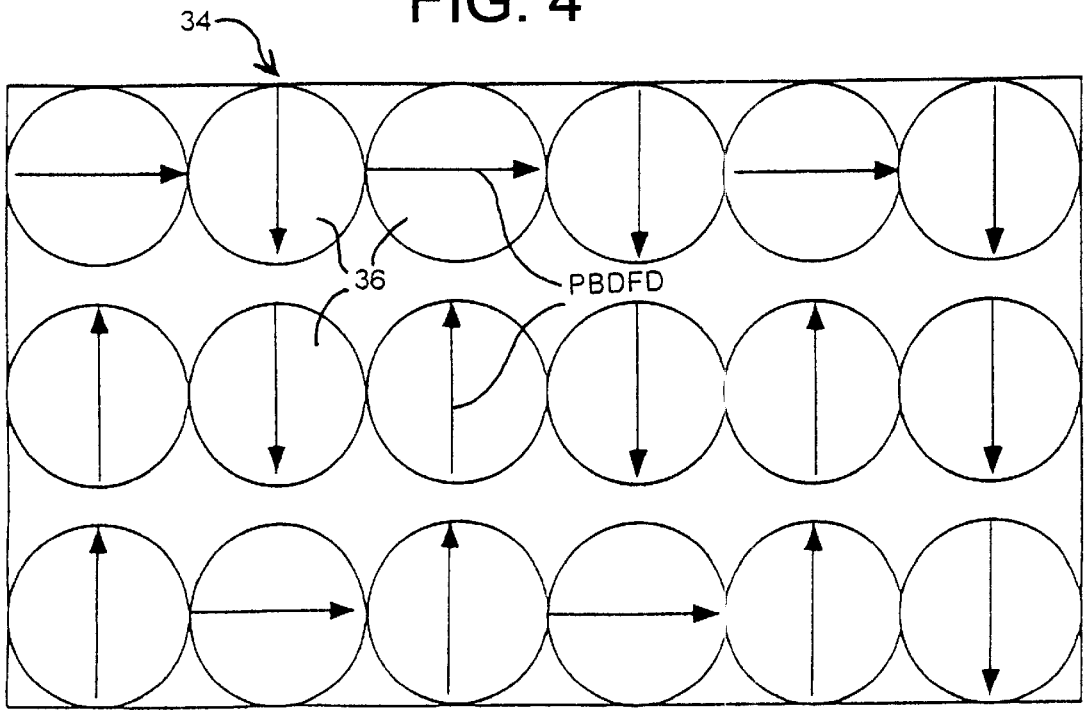
FIG. 4 is a partially schematic plan view of another electrolysis cell having eighteen inert anodes which generate an oxygen bubble flow pattern in accordance with another embodiment of the present invention.

FIG. 4 is a partially schematic top view of another electrolysis cell 34 having eighteen inert anodes 36 in accordance with a further embodiment of the present invention. In this embodiment, the angled lower surfaces of the inert anodes 36 are oriented such that they generate a serpentine flow pattern in the cell 34.

Figure 5:
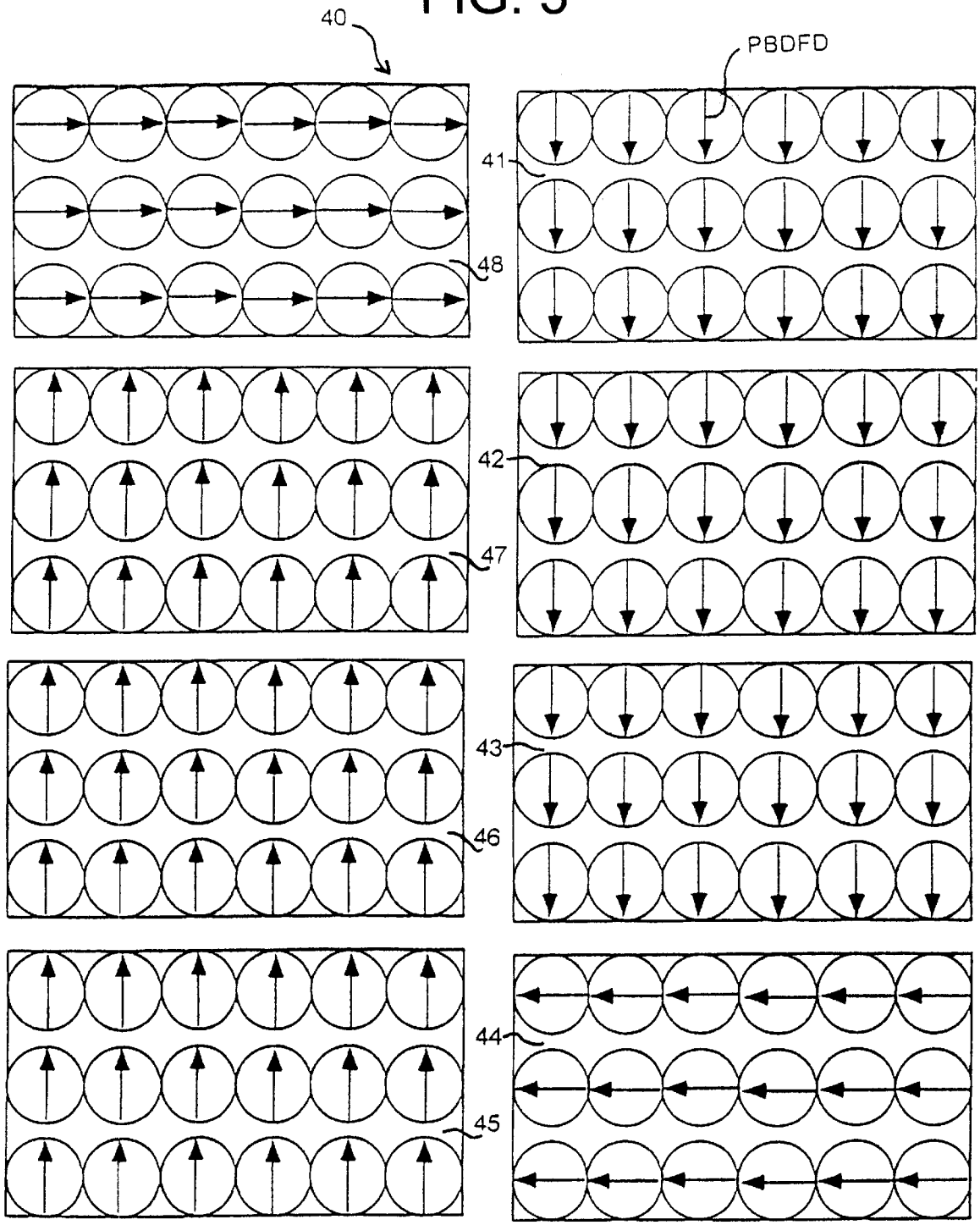
FIG. 5 is a partially schematic plan view of an array of inert anode clusters for generating a controlled oxygen bubble flow pattern in an electrolysis cell in accordance with a further embodiment of the invention.

FIG. 5 is a partially schematic top view of an array 40 of inert anode clusters 41–48. In this embodiment, the inert anodes in each individual cluster have angled lower surfaces oriented in the same direction. Adjacent clusters are arranged such that an overall clockwise PBDFD flow pattern is generated by the array 40.

This invention would not be suitable for cells including consumable carbon anodes because carbon anodes "burn off" into a characteristic shape over time due to reaction with species in the bath. Carbon anodes are changed in sequence so that only a small percentage of them would retain the initial slope at any time. In contrast, the slopes on the bottom of inert anodes in accordance with the present invention are substantially preserved over the life of the anodes. Therefore, once initiated by proper sloping and orienting of a group of anodes, the circulation should continue indefinitely.

It is noted that sloped anodes have been proposed for use in a cell operating with a sloped drainable cathode and without a metal pad. In this type of cell the slopes of the anodes and cathodes are parallel and current density is uniform. The present invention relates primarily to cells that have a metal pad, resulting in a flat cathode. When a sloped anode is used in a cell with a flat metal pad one disadvantage is that the current density is higher at the lower end of the slope. High current density is detrimental to corrosion resistance of the inert anode. In accordance with the present invention, it has been found that only a very slight slope, e.g., 0.5–3 degrees, is required to achieve a preferred bubble-driven flow direction. By using a group of anodes to reinforce the effect, good circulation can be achieved without creating regions of high current density.

By applying this invention so as to create circulation loops with sloped and oriented anodes and position feeders in optimized locations, the time to achieve uniformity can be reduced substantially, e.g., to a few minutes.

Another advantage of inducing cell circulation is that fewer feeders are needed to achieve adequate uniformity in alumina concentration. Alumina fed through a point feeder can be distributed quickly over a relatively large distance by the circulation loop. Without inducing cell circulation and relying only on local circulation, several feeders are required for each anode in order to maintain near saturated conditions everywhere under the anode bottom.

Another advantage of a sloped anode is reduced voltage drop. The additional voltage drop across a bubble layer in an inert anode cell has been calculated from pilot cell data to be 0.5–1. volt, compared to 0.25 volt with a carbon anode. This increase is due to the smaller bubble size on the inert anode. Grooves in the anode bottoms have been proposed to reduce the voltage drop, but such grooves result in corners with high current density and are more expensive to manufacture. A slight slope on the anode bottom has been found to reduce the voltage drop across the bubble layer without large variations in current density.

Another advantage of a slight slope is anode protection. Bath contains dissolved aluminum and may contain small droplets of undissolved aluminum. Maintaining coverage of the anode sides with oxygen bubbles results in an oxidizing barrier that minimizes reaction of the aluminum with the anode. These bubbles are relatively small, on the order of 1 mm in diameter, compared to those generated on carbon anodes (1 cm–1 m) because the alumina concentration must be maintained at or near saturation and the bubble size varies inversely with alumina concentration. If the anode bottom has a steep slope, bubbles, especially large ones, will tend to flow up the higher half of the anode, leaving the lower half relatively unprotected. In contrast, a curtain of small bubbles will protect the entire sides of anodes that have only a slight slope.

Another advantage of the present sloped anode is that, relative to a flat anode, bath turbulence is increased in the region adjacent to the anode in the PBDFD. This region is preferred for adding alumina from a point feeder since heat transfer and mixing are enhanced.

What is claimed is:

1. An electrode assembly for an electrolytic aluminum production cell, the assembly comprising:

at least one anode having a lower surface sloped at an angle of from about 0.5 degrees to about 3 degrees measured from a horizontal plane and a cathode at least partially positioned below the at least one anode comprising a molten aluminum pool, wherein said cathode has a substantially flat upper surface and is substantially parallel to the horizontal plane.

2. The electrode assembly according to claim 1 wherein said anode is an inert anode.

3. The electrode assembly according to claim 2 wherein said inert anode comprises a cermet material.

4. The electrode assembly according to claim 3 wherein said cermet material comprises an oxide matrix based on nickel ferrite.

5. The electrode assembly according to claim 1 wherein said assembly comprises a plurality of said anodes, each said anode having a sloped lower surface measured from the horizontal plane.

6. The electrode assembly according to claim 5 wherein said anodes are arranged in an array such that during operation of the electrolytic aluminum production cell the sloped lower surfaces of said anodes generate an oxygen bubble flow pattern in an electrolytic bath of the cell wherein said bubble flow pattern facilitates circulation of the electrolytic bath.

7. The electrode assembly according to claim 6 wherein said oxygen bubble flow pattern substantially follows the upward direction of the sloped lower surfaces of said anodes.

8. The electrode assembly according to claim 1 wherein the electrode assembly comprises at least four of said anodes.

9. An electrolytic aluminum production cell comprising:

an array of anodes, each said anodes having a lower surface sloped at an angle of from about 0.5 degrees to about 3 degrees measured from a horizontal plane, a cathode at least partially positioned below the array of anodes plane comprising a molten aluminum pool, wherein said cathode has a substantially flat upper surface and is substantially parallel to the horizontal plane; and an electrolytic bath in the cell contacting the array of anodes and the cathode.

10. The electrolytic aluminum production cell according to claim 9 wherein said anodes are inert anodes.

11. The electrolytic aluminum production cell according to claim 9 wherein said inert anodes comprises a cermet material.

12. The electrolytic aluminum production cell according to claim 11 wherein said cermet material comprises an oxide matrix based on nickel ferrite.

13. The electrolytic aluminum production cell according to claim 9 wherein said anodes are arranged in the array such that during operation of the electrolytic aluminum production cell the sloped lower surfaces of said anodes generate an oxygen bubble flow pattern in an electrolytic bath of the cell wherein said bubble flow pattern facilitates circulation of the electrolytic bath.

14. The electrolytic aluminum production cell according to claim 13 wherein said oxygen bubble flow pattern substantially follows the upward direction of the slope.

15. An electrolytic aluminum production cell composing:

an array of anodes, each said anode having a lower surface sloped at an angle of from about 0.5 degrees to about 3 degrees measured from a horizontal plane;

a cathode at least partially positioned below the array of anodes comprising a molten aluminum pool, wherein the cathode has a substantially flat upper surface and is substantially parallel to the horizontal plane; and an electrolytic bath in the cell contacting the array of anodes and the cathode, wherein the array of anodes are arranged such that during operation of the electrolytic aluminum production cell the sloped lower surfaces of said anodes generate an oxygen bubble flow pattern in the electrolytic bath of the cell wherein said bubble flow pattern facilitates circulation of the electrolytic bath.

16. The electrolytic aluminum production cell according to claim 15 wherein said oxygen bubble flow pattern substantially follows the upward direction of the slope.

17. An electrolytic aluminum production cell comprising:

an array of inert anodes, each said inert anode having a sloped lower surface having an angle of from 0.5 to 3 degrees measured from a horizontal plane, wherein the array of inert anodes are arranged such that during operation of the electrolytic aluminum production cell the sloped lower surfaces of said inert anodes generate an oxygen bubble flow pattern in the electrolytic bath of the cell wherein said bubble flow pattern facilitates circulation of the electrolytic bath.

18. A method of forming a circulation pattern in an electrolytic aluminum production cell comprising:

providing an array of anodes in said cell, each said anodes having a lower surface sloped at an angle of from about 0.5 degrees to about 3 degrees measured from a horizontal plane, providing a cathode in the cell, wherein the cathode has a substantially flat upper surface and is substantially parallel to the horizontal plane;

providing an electrolytic bath; and generating an oxygen bubble flow pattern in the electrolytic bath of the cell to form a circulation pattern in said cell.

* * * * *